US010850914B2

(12) United States Patent
Bartolucci et al.

(10) Patent No.: US 10,850,914 B2
(45) Date of Patent: Dec. 1, 2020

(54) DIP TUBE AEROSOL DISPENSER WITH UPRIGHT ACTUATOR

(71) Applicant: The Procter & Gamble Company, Cincinnati, OH (US)

(72) Inventors: Stefano Bartolucci, Singapore (SG); Douglas Charles Cook, South Lebanon, OH (US); Christopher Raymond Lo, Cincinnati, OH (US); Jazmin Veronica Torres Rivera, Liberty Township, OH (US); Kerry Lloyd Weaver, Florence, KY (US)

(73) Assignee: The Procter and Gamble Company, Cincinnati, OH (US)

( * ) Notice: Subject to any disclaimer, the term of this patent is extended or adjusted under 35 U.S.C. 154(b) by 0 days.

(21) Appl. No.: 16/184,367

(22) Filed: Nov. 8, 2018

(65) Prior Publication Data

US 2020/0148458 A1 May 14, 2020

(51) Int. Cl.

| | |
|---|---|
| ***B65D 83/20*** | (2006.01) |
| ***B65D 83/44*** | (2006.01) |
| ***B65D 83/32*** | (2006.01) |

(52) U.S. Cl.

CPC ..... *B65D 83/201* (2013.01); *B65D 83/32* (2013.01); *B65D 83/44* (2013.01)

(58) Field of Classification Search

CPC ..... B65D 83/32; B65D 83/44; B65D 83/201
USPC ..... 222/402.13, 402.21, 470
See application file for complete search history.

(56) References Cited

U.S. PATENT DOCUMENTS

| | | | | |
|---|---|---|---|---|
| 2,430,718 | A | 11/1947 | Jacobson | |
| 3,104,785 | A | 9/1963 | Beard, Jr. | |
| 3,235,135 | A | 2/1966 | Henri | |
| 3,247,640 | A | 4/1966 | DeWayne Miles et al. | |
| 3,250,444 | A | 5/1966 | Ward | |
| 3,981,419 | A | 9/1976 | Nilson | |
| 4,122,845 | A | 10/1978 | Stouffer | |
| D267,855 | S | 2/1983 | French | |
| 4,433,797 | A | 2/1984 | Galia | |
| 4,562,942 | A | 1/1986 | Diamond | |
| 4,592,743 | A | 6/1986 | Hjertman et al. | |
| 4,694,975 | A * | 9/1987 | Hagan | B67D 1/0456 215/4 |
| 4,877,156 | A | 10/1989 | Clanet | |
| 4,892,232 | A | 1/1990 | Martin | |
| 4,896,832 | A | 1/1990 | Howlett | |

(Continued)

FOREIGN PATENT DOCUMENTS

| | | | |
|---|---|---|---|
| DE | 3147004 | A1 | 5/1983 |
| DE | 19937554 | A1 | 3/2001 |

(Continued)

OTHER PUBLICATIONS

All final and non-final office actions for U.S. Appl. No. 15/926,075.

(Continued)

*Primary Examiner* — Vishal Pancholi
(74) *Attorney, Agent, or Firm* — Alexandra S. Anoff

(57) ABSTRACT

An aerosol foam dip tube dispenser with an axis of symmetry with a pressurizable outer container for storing a propellant and a composition under pressure and an actuator. The aerosol dispenser is ergonomic and promotes upright dispensing in order to avoid degassing.

20 Claims, 15 Drawing Sheets

(56) References Cited

U.S. PATENT DOCUMENTS

| | | | | |
|---|---|---|---|---|
| 4,919,312 | A | 4/1990 | Beard | |
| 4,941,598 | A | 7/1990 | Lambelet, Jr. | |
| 5,031,802 | A | 7/1991 | Joulia | |
| 5,056,690 | A | 10/1991 | Ichihara | |
| 5,105,995 | A | 4/1992 | Martin | |
| 5,199,616 | A | 4/1993 | Martin | |
| 5,429,280 | A | 7/1995 | Bauer et al. | |
| 5,441,181 | A | 8/1995 | Scheindel | |
| 5,520,310 | A | 5/1996 | Bauer et al. | |
| 5,577,641 | A | 11/1996 | De Laforcade | |
| 5,624,055 | A | 4/1997 | Clanet | |
| 5,875,927 | A | 3/1999 | Andrade | |
| 5,904,274 | A | 5/1999 | Warby | |
| 5,914,085 | A | 6/1999 | Zimmerhackel | |
| 6,004,300 | A | 12/1999 | Butcher | |
| 6,095,182 | A | 8/2000 | Warby | |
| 6,260,738 | B1 | 7/2001 | Kerr | |
| 6,334,553 | B1 | 1/2002 | Bouras | |
| 6,405,898 | B1 | 6/2002 | O'Connor | |
| 6,745,920 | B2 | 6/2004 | Gupta | |
| 7,104,424 | B2 | 9/2006 | Kolanus | |
| 7,306,123 | B2 | 12/2007 | Masuda | |
| 7,306,124 | B2 | 12/2007 | Masuda | |
| 7,665,923 | B2 | 2/2010 | Py et al. | |
| 8,006,868 | B2 | 8/2011 | Geiberger et al. | |
| 8,387,827 | B2 * | 3/2013 | Helf | A01M 1/2038 222/52 |
| 8,616,417 | B2 * | 12/2013 | Neuhaus | B65D 47/2031 222/402.13 |
| 8,720,747 | B2 * | 5/2014 | Hoagland | B05B 1/3046 222/402.13 |
| 9,211,994 | B2 * | 12/2015 | Andersen | B65D 83/201 |
| 9,403,636 | B2 | 8/2016 | Bodet et al. | |
| 9,469,468 | B2 | 10/2016 | Shibata et al. | |
| 10,022,740 | B2 | 7/2018 | Van Swieten et al. | |
| 10,364,093 | B2 | 7/2019 | Bartolucci | |
| 10,625,929 | B2 | 4/2020 | Bartolucci | |
| 10,625,930 | B2 | 4/2020 | Takahashi | |
| 2002/0162450 | A1 | 11/2002 | Frost | |
| 2006/0065677 | A1 | 3/2006 | Py | |
| 2006/0196889 | A1 | 9/2006 | Masuda | |
| 2007/0051754 | A1 * | 3/2007 | Strand | B65D 83/206 222/402.13 |
| 2007/0095853 | A1 | 5/2007 | Bonney et al. | |
| 2007/0125799 | A1 | 6/2007 | Bonney | |
| 2007/0137643 | A1 | 6/2007 | Bonney | |
| 2007/0164049 | A1 | 7/2007 | Bonney | |
| 2007/0175917 | A1 | 8/2007 | Bonney | |
| 2008/0061083 | A1 | 3/2008 | Masuda | |
| 2008/0149098 | A1 | 6/2008 | Bonney | |
| 2008/0272144 | A1 | 11/2008 | Bonney | |
| 2010/0308082 | A1 | 12/2010 | Lamble | |
| 2011/0011889 | A1 | 1/2011 | Bonney | |
| 2012/0006859 | A1 * | 1/2012 | Wilkinson | B65D 83/205 222/402.21 |
| 2013/0019802 | A1 | 1/2013 | Leck | |
| 2013/0068119 | A1 | 3/2013 | Kennedy | |
| 2014/0209633 | A1 | 7/2014 | Mcdaniel | |
| 2015/0090736 | A1 * | 4/2015 | Erickson | B65D 83/205 222/153.1 |
| 2016/0129197 | A1 | 5/2016 | Hetting | |
| 2018/0072485 | A1 | 3/2018 | Fore | |
| 2019/0071242 | A1 | 3/2019 | Bartolucci | |
| 2019/0152684 | A1 | 5/2019 | Bartolucci | |
| 2020/0148459 | A1 | 5/2020 | Bartolucci | |

FOREIGN PATENT DOCUMENTS

| | | | |
|---|---|---|---|
| DE | 202016101580 | U1 | 8/2017 |
| FR | 1454371 | A | 9/1966 |
| FR | 2311593 | A1 | 12/1976 |
| FR | 2990421 | B1 | 2/2015 |
| GB | 1414637 | A | 11/1975 |
| JP | 0220959 | U | 2/1990 |
| JP | 0462677 | U | 5/1992 |
| JP | 2018058591 | A | 4/2018 |
| WO | WO2004045778 | A1 | 6/2004 |
| WO | 2017115827 | A1 | 7/2017 |

OTHER PUBLICATIONS

All final and non-final office actions for U.S. Appl. No. 16/118,663.
All final and non-final office actions for U.S. Appl. No. 16/194,502.
European Search Report for 17162178.2 dated Aug. 21, 2017.
European Search Report for EP 171758527 dated Sep. 19, 2017.
European Search Report for EP 17189053.6 dated Feb. 28, 2018.
European Search Report for EP 17203315.1 dated Apr. 5, 2018.
U.S. Appl. No. 16/194,502, filed Nov. 19, 2018, Bartolucci et al.
PCT International Search Report and Written Opinion for PCT/US2018/058653 dated Jan. 25, 2019.
U.S. Appl. No. 16/666,879, filed Nov. 1, 2019, Bartolucci et al.
All final and non-final office actions for U.S. Appl. No. 16/666,879.
U.S. Appl. No. 16/907,677, filed Jun. 22, 2020, Bartolucci et al.
All final and non-final office actions for U.S. Appl. No. 16/907,677.
European Search Report for EP18152909.0 dated Jun. 18, 2018.
PCT International Search Report and Written Opinion for PCT/US2019/012453 dated Apr. 1, 2019.
PCT International Search Report and Written Opinion for PCT/US2019/060172 dated Apr. 23, 2020.
PCT International Search Report and Written Opinion for PCT/US2019/060173 dated Jun. 2, 2020.

* cited by examiner

DIP TUBE AEROSOL DISPENSER WITH UPRIGHT ACTUATOR

FIELD OF THE INVENTION

The present invention relates to aerosol foam dispenser that dispenses, particularly an aerosol dip tube foam dispenser with an ergonomic actuator such that it is optimized for in-shower use with shampoos, hair conditioners, and body washes.

BACKGROUND OF THE INVENTION

Many consumers prefer using beauty products in a foam form. Foaming styling products including mousses and foaming hand soaps are common. However, there are few acceptable foaming in-shower products such as shampoos, hair conditioners, and body washes. One reason is that it is difficult to design a foam dispenser that is easy to use in the shower and dispenses a high-quality foam for the entire life of the product.

Single chamber aerosols can be advantageous to dispense foaming products over dual compartment aerosols (such as piston or bag-in-can or bag-on-valve) due to their lower manufacturing, packing, and filling costs and reduced complexity. Among single chamber aerosols, upright pump style dip tube aerosols are generally preferred by consumers over inverted cans for in-shower dispensing of foam products. One of the reasons is that in inverted aerosols the orifice is substantially aligned to the can axis, this can be messy because when the foam is dispensed into the palm, it sticks to the dispenser. Additionally, the consumer has limited visual contact with the dispensed foam in her palm because the device is positioned between her eyes and her palm. This lack of visual contact can prevent the consumer from perceiving and controlling the desired amount to be dispensed and can cause odd dispensing ergonomics.

While preferred, many current upright dip tube aerosols foam dispensers also have challenges as they can require a stable surface for easy dispensing. However, Consumers generally do not have a convenient and/or stable surface in the shower to dispense foam products, since they store their products on the edge of a bathtub or in shower caddies suspended on tension poles or over the showerhead. Therefore, in the shower, consumers only have one hand to activate the actuator and hold the dispenser because they need to dispense the foam into the open palm of the opposite hand or into sponge, shower puff, loofa, wash cloth or other cleaning implement that is held in the opposite hand.

Furthermore, consumers often tilt foam dispensers, so the product dispenses into her flat palm, so the foam doesn't drop to the shower floor. However, when aerosol dip tube dispensers are actuated at an angle, the dip tube can draw propellant directly from the headspace thus causing the product to degass (i.e. the propellant trapped in the concentrate will gradually move to the headspace to set to a new equilibrium). Degassing can cause irreversible changes in the dispensing and foaming characteristics. If degassing events occur repeatedly, consumers may notice that it is difficult or impossible to dispense the product and if the product is dispensed it is a watery mess, instead of a rich high-quality foam.

As such, there remains a need for a dip tube aerosol dispenser that is ergonomically designed so it can be operated with one hand and intuitively dispensed upright to minimize degassing.

SUMMARY OF THE INVENTION

An aerosol dispenser with an axis of symmetry comprising: (a) a pressurizable outer container for storing a propellant and a composition under pressure; (b) an actuator having an outer surface where the actuator is attached to a top of the outer container comprising: (i) a valve being movable to an open position to release a mixture of the aerosol and the composition; (ii) a trigger located above the valve for actuating the valve where the trigger has a direction of actuation from about −10° to about 60° from the axis of symmetry of the dispenser at the beginning of a stroke; (iii) a longitudinally extending nozzle having a top surface, a bottom surface, a nozzle surface comprising one or more shaping orifices with a nozzle direction from less than or equal to 85° from the axis of symmetry of the dispenser; wherein said orifices are in fluid communication with the valve; wherein the bottom surface and the outer surface of the actuator create an overhang adapted for receiving the at least a portion of a little finger on a user's receiving hand; wherein the overhang is shaped to accommodate a semi-cylinder with a radius from about 10 mm to about 30 mm; (iv) a dip tube where an end of the dip tube is connected to the valve.

An aerosol dispenser with an axis of symmetry comprising: (a) a pressurizable outer container for storing a propellant and a composition under pressure; (b) an actuator having an outer surface where the actuator is attached to a top of the outer container comprising: (i) a valve being movable to an open position to release a mixture of the aerosol and the composition; (ii) a trigger located above the valve for actuating the valve where the trigger has a direction of actuation from about −10° to about 60° from the axis of symmetry of the dispenser at the beginning of a stroke; (iii) a longitudinally extending nozzle having a top surface, a bottom surface, a nozzle surface comprising one or more shaping orifices with a nozzle direction less than 100° from the axis of symmetry of the dispenser; wherein the bottom surface and the outer surface of the actuator create an overhang adapted for receiving the at least a portion of a little finger on a user's receiving hand; wherein the overhang is shaped to accommodate a semi-cylinder with a radius greater than 20 mm; (iv) a dip tube where an end of the dip tube is connected to the valve.

BRIEF DESCRIPTION OF THE DRAWINGS

While the specification concludes with claims particularly pointing out and distinctly claiming the subject matter of the present invention, it is believed that the invention can be more readily understood from the following description taken in connection with the accompanying drawings, in which:

DETAILED DESCRIPTION OF THE INVENTION

While the specification concludes with claims particularly pointing out and distinctly claiming the invention, it is believed that the present disclosure will be better understood from the following description.

Many consumers want shampoo, conditioner, and/or body wash dispensed as an aerosol foam. Some consumers think these products are easier to use and spread more easily across the body, hair, and/or scalp, which can ultimately enhance the user's experience and lead to better cleaning and/or conditioning results. However, there are few acceptable foaming in-shower products, especially in aerosol dip tube dispensers.

It can be hard to design an aerosol dip tube dispenser that is easy to use and dispenses a creamy, high-quality foam across the entire life of the product. First, in the shower consumers generally only have one hand to activate the actuator and hold the dispenser and thus the dispenser can be operable with one hand. Further, aerosol containers are not ergonomically designed to allow people to easily and intuitively dispense the foam in an upright position into a flat palm and when a dip tube container is actuated at an angle, it will eventually degas, causes irreversible changes in the dispensing and foaming characteristics.

It was found that if during dispensing the dip tube aerosol dispenser had a 98% ile (98th percentile) tilt angle of 90° relative to an axis perpendicular to the ground or less during dispensing, the aerosol dispenser was less likely to degas. The propensity to tilt a pump style aerosol dispenser during use thereby degassing the dispenser can be mitigated by promoting upright dispensing. The aerosol dispenser, particularly the actuator, can have an ergonomic design that can make it more intuitive to avoid tilting the aerosol more than 90° during use.

Figure 11:
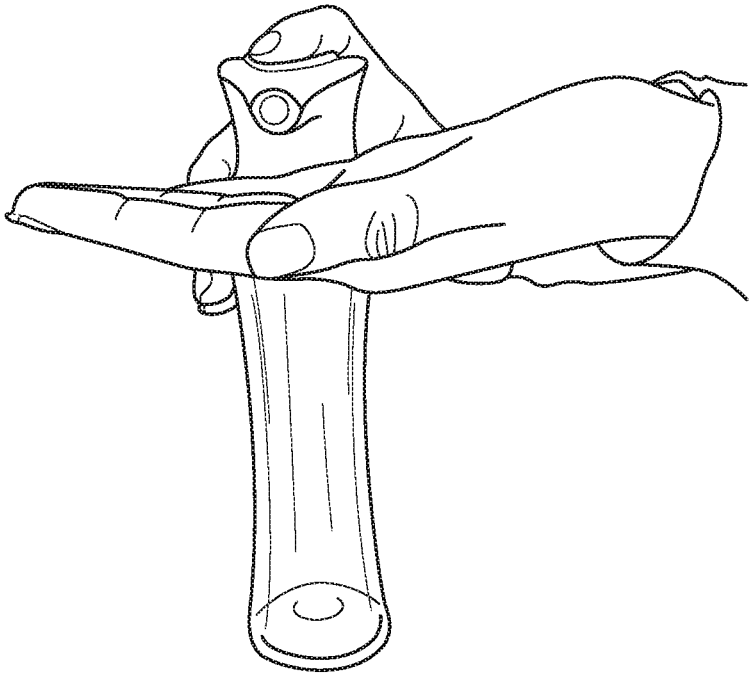
FIG. 11 is an example of how a dispenser can be held upright during actuation.

First, the aerosol dispenser can have an overhang below the nozzle. The overhang can be shaped to accommodate a semi-cylinder with a have a radius that allows at least half a finger of the receiving hand to fit under the nozzle, creating a "lock and key." The overhang can help promote upright dispensing because it guides the receiving hand to a position that is both natural for receiving a foam product (palm up, approximately parallel to the ground) and makes it natural to dispense the foam without tilting the dispenser, an example is shown in FIG. 11. If the overhang is too small, regardless of the actuation direction and the nozzle direction, the user is going to tilt the dispenser too much to dispense the product.

The overhang can be shaped to accommodate a semi-cylinder with a radius from about 10 mm to about 45 mm, alternatively from about 11 mm to about 40 mm, alternatively from about 11 mm to about 35 mm, alternatively from about 12 mm to about 30 mm, alternatively from about 15 mm to about 28 mm, alternatively from about 15 mm to about 25 mm. The radius can be determined by the Overhang Radius Method, described hereafter.

The direction of actuation can also indicate how much the consumer will tilt the dispenser during use. It was found that consumers tend to align the axis of symmetry of the dispenser substantially in the direction of actuation.

The direction of actuation can be from about −10° to about 60° from the axis of symmetry of the dispenser or valve, alternatively from about −7° to about 60°, alternatively from about −5° to about 45°, and alternatively from about 0° to about 35°. The direction of actuation can be determined by the Direction of Actuation Method, described hereafter.

The nozzle direction can also indicate how much the consumer will tilt the dispenser during use. The consumer generally wants to direct the foam into an open, flat, palm in a receiving/non-dispensing hand. The consumer will tilt the dispenser so the nozzle surface is approximately parallel to her hand.

The nozzle direction can be from about 5° to about 110°, alternatively from about 7° to about 100° from the axis of symmetry of the dispenser or valve, alternatively from about 10° to about 95°, alternatively from about 20° to about 90°, alternatively from about 40° to about 88°, alternatively from about 50° to about 87°, and alternatively from about 55° to about 85°. The nozzle direction can be determined with the Nozzle Direction Method, described hereafter.

While dispensing, the user tends to put the nozzle surface against her palm or close to her palm and a larger nozzle surface can also minimize the propensity to tilt the dispenser during use. The surface area of the nozzle surface can be balanced between making it large to promote proper placement and small enough for the user can main maintain visual contact with the foam product being dispensed during actuation. The nozzle surface can be substantially flat with a surface area from about 50 $mm^2$ to about 2500 $mm^2$, alternatively from about 100 $mm^2$ to about 1250 $mm^2$, alternatively from about 200 $mm^2$ to about 750 $mm^2$, alternatively from about 300 $mm^2$ to about 500 $mm^2$.

During use, the pump style aerosol dispenser can have a 98% ile tilt angle of about 0° to about 90°, alternatively from about 0° to about 80°, alternatively from about 0° to about 76°, alternatively from about 0° to about 67.5°, alternatively from about 0° to about 60°, alternatively from about 0° to about 55°, alternatively from about 0° to about 50°, alternatively from about 0° to about 45°, and alternatively from about 0° to about 22.5°. The 98% ile tilt angle can be determined with the Aerosol Dispenser Tilt Angle Method, described hereafter.

The actuator peak force-to-actuate can be low enough to allow at least 90% of global non-impaired adult users between 18 and 65 years old use the package without compensating behavior such as pushing the container base against their belly, according to the Dispensing Observational Behavior Research test method described hereafter. The peak force to actuate can be ≤35 N, alternatively ≤30 N, alternatively ≤25 N and alternatively ≤20 N. The force to actuate can be ≥5N to avoid accidental actuation. The peak for to actuate can be determined by the Peak Force-to-Actuate test method, described hereafter. If too much force is required to actuate the dispenser, the consumer may over tile the aerosol dispenser.

The outer container can be shaped to promote grasp/grip during dispensing. In one example, the outer container can be concaved and/or contoured. This can be useful as the water and/or soap tends to make the surface of the container particularly slippery. The shoulder of the container can be larger than the base to promote hand support. Alternatively, the container can include one or more ribs or protruding features in the outer surface and/or can include a soft touch material to both provide support and increase friction with the consumer hand.

The actuator can be designed to act as actuator and not a support structure during storage. In some instances, the actuator's shape does not allow it to act as a support structure during storage. In some examples, the container can have a cap covering the actuator and the container's camp may be domed, slanted, or otherwise shaped so it cannot be used as a support structure. This is to eliminate potential misuse with consumers storing the aerosol upside down, which can cause degassing, especially if the product has low flowability.

It should be understood that every maximum numerical limitation given throughout this specification includes every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

Aerosol Dispenser

Figure 1:
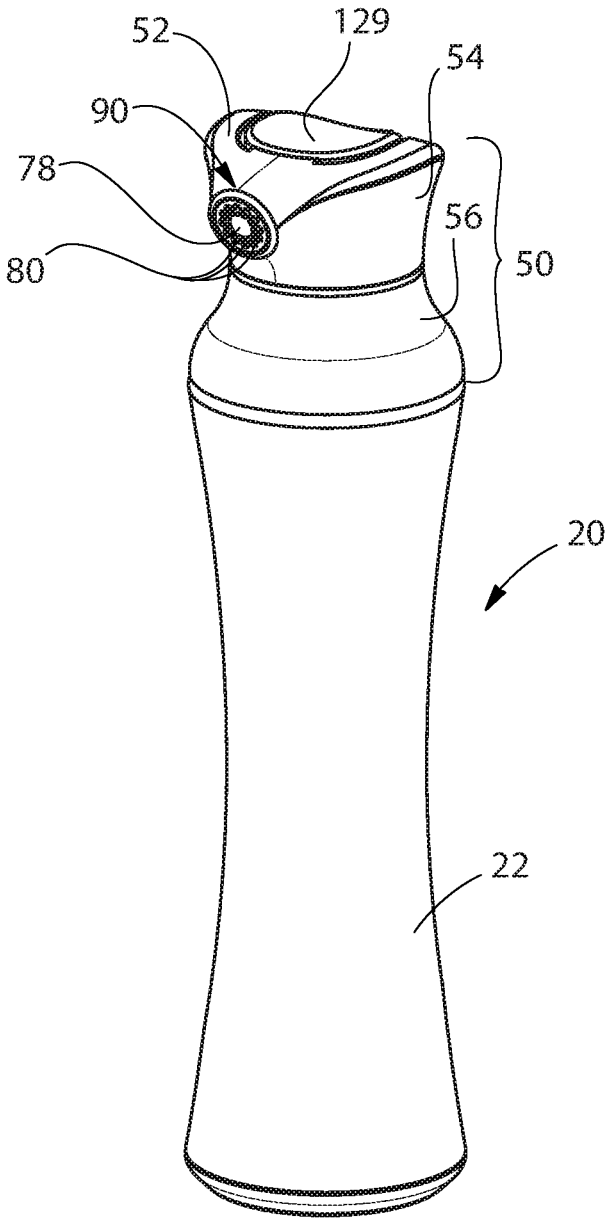
FIG. 1 is a perspective view of an aerosol dispenser.
Figures 2, 3, 4:
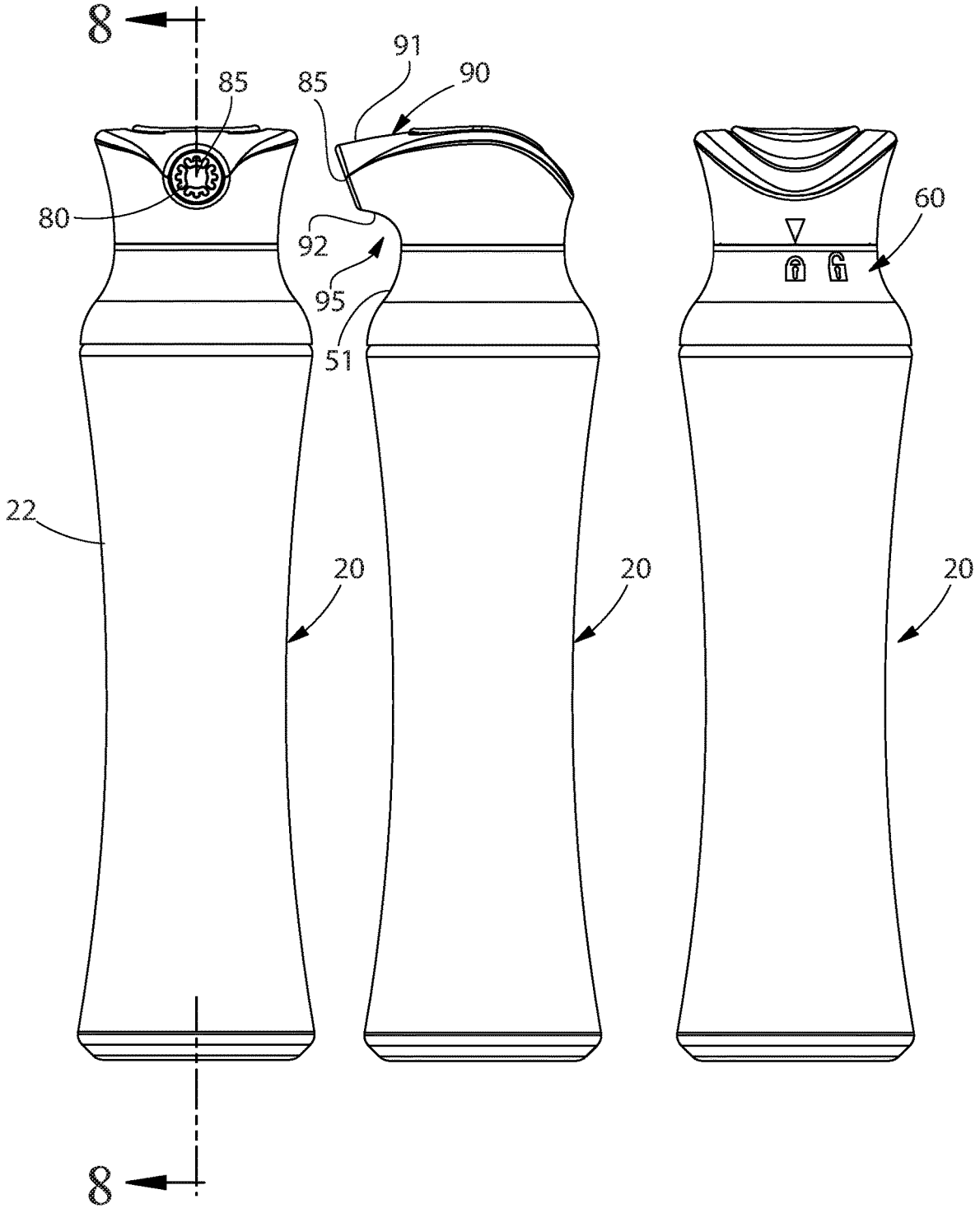
FIG. 2 is a front view of the dispenser of FIG. 1.
FIG. 3 is a left side of the dispenser of FIG. 1.
FIG. 4 is a rear view of the dispenser of FIG. 1.

Referring to FIGS. 1 and 2, a pump style aerosol dispenser 20 is shown. The aerosol dispenser 20 can comprise a pressurizable outer container 22 and actuator 50 usable for such a dispenser 20. The actuator 50 can include a shroud 56, an actuator body 54, and a toupee 52. The shroud 56, actuator body 54, and toupee 52 can be a single piece and/or separate pieces. The toupee 52 can also include a trigger 129 that may be used to dispense product through the one or more shaping orifices 80 at the point of use. The shaping orifices 80 can be at the distal end of the nozzle 90 and can be on the nozzle surface 78. The nozzle surface can be flat or primarily flat. In other examples, the nozzle surface can be concave and/or convex. The nozzle 90 can be an integrated with toupee 52 and/or actuator body 54 or it can be a separate component.

The trigger 129 can be pressed down with a user's finger, generally the index finger on the user's dominant hand and in other instances, the user's thumb on the user's dominant hand. The user's finger can be planar with the trigger's surface and will actuate the trigger at an actuation direction. In the example in FIGS. 1-10, trigger 129 is a button at the top of the actuator. In other examples, the trigger could be a trigger spray and/or located in a different position on the actuator.

The outer container 22 may be injection stretch blow molded (ISBM). Additionally, the containers 22 may be injection blow molded or extrusion blow molded. If ISBM is selected, a 1 step, 1.5 step or 2 step process may be used.

Figure 5:
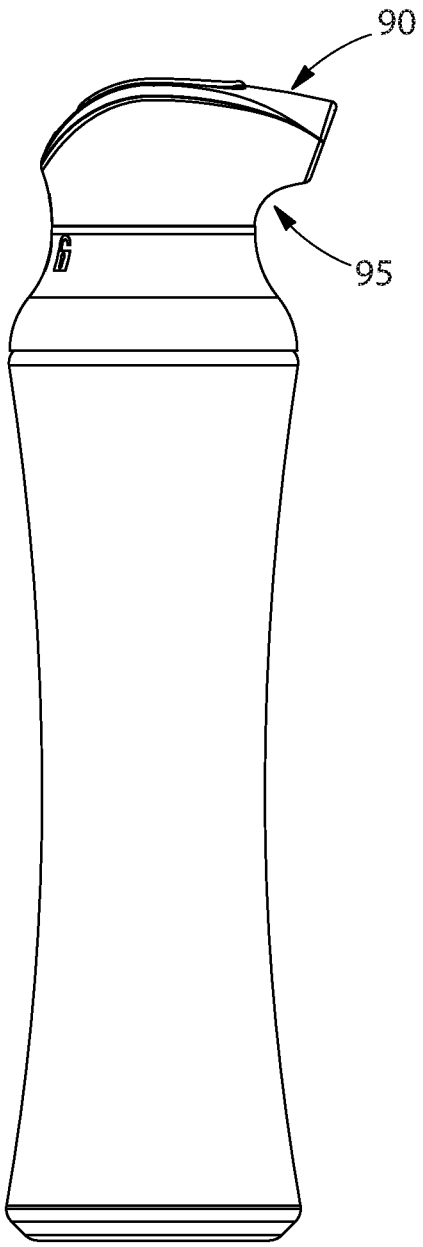
FIG. 5 is a right side view of the dispenser of FIG. 1.
Figure 6:
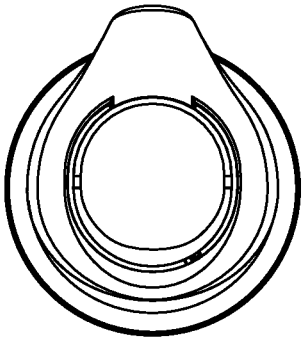
FIG. 6 is a top view of the dispenser of FIG. 1.
Figure 7:
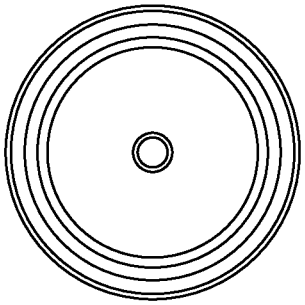
FIG. 7 is a bottom view of the dispenser of FIG. 1.

FIGS. 3 and 5 show a left side view and a right side view, respectively, of pump style aerosol dispenser 20. The side views show nozzle 90 extending longitudinally from aerosol dispenser 20. Nozzle 90 has a top surface 91 and a bottom surface 92. In this example, the bottom surface 92 and outer surface of the actuator 51 can create overhang 95. In another example, the bottom surface of the nozzle and the outer container can create the overhang. Overhang 95 can be adapted so the consumer can at least a portion of a finger, in particular the side of the little finger, of the receiving hand underneath the nozzle, as shown in FIG. 11. In one example, the overhang is adapted to receive about half of an adult's little finger.

FIG. 4 shows a rear view of aerosol dispenser 20 with locking mechanism 60.

Figure 8:
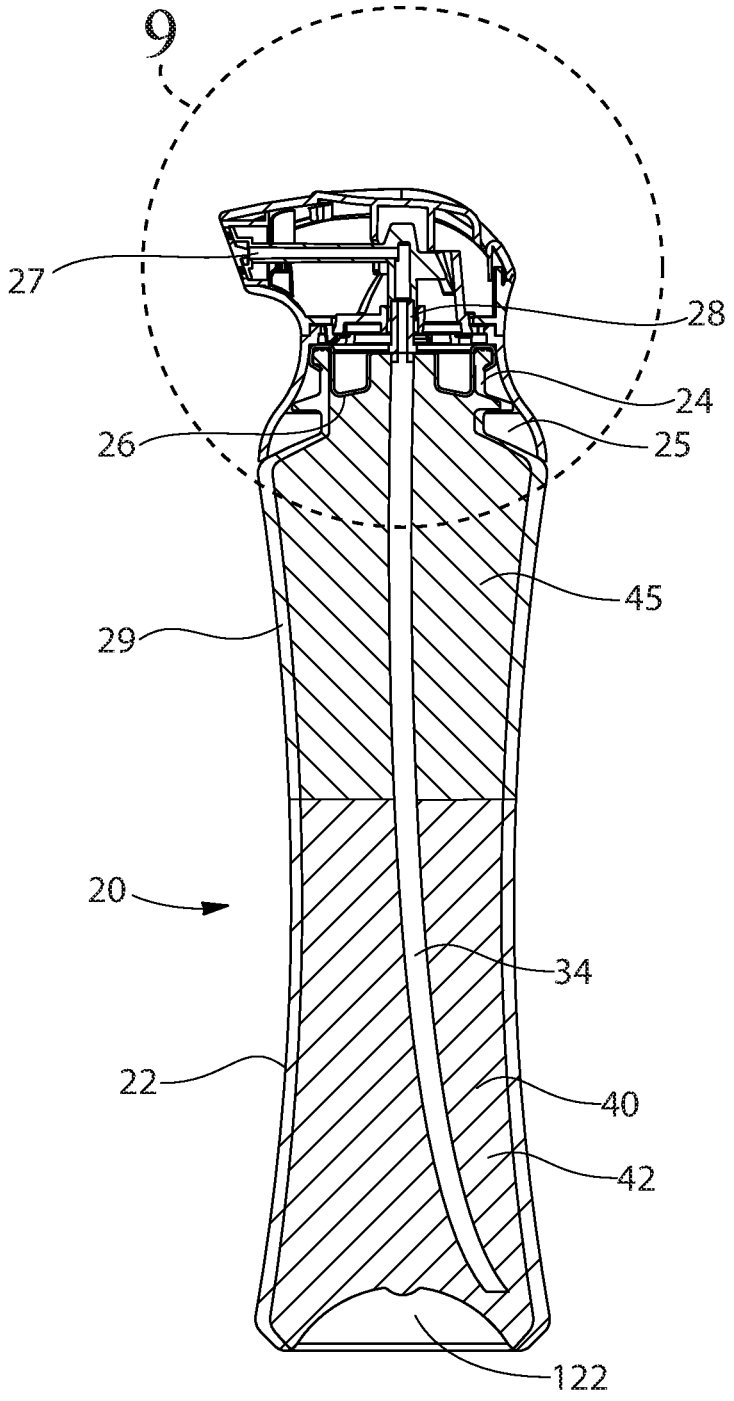
FIG. 8 is a cross-sectional view of the aerosol dispenser of FIG. 2 along line 8.
Figure 9:
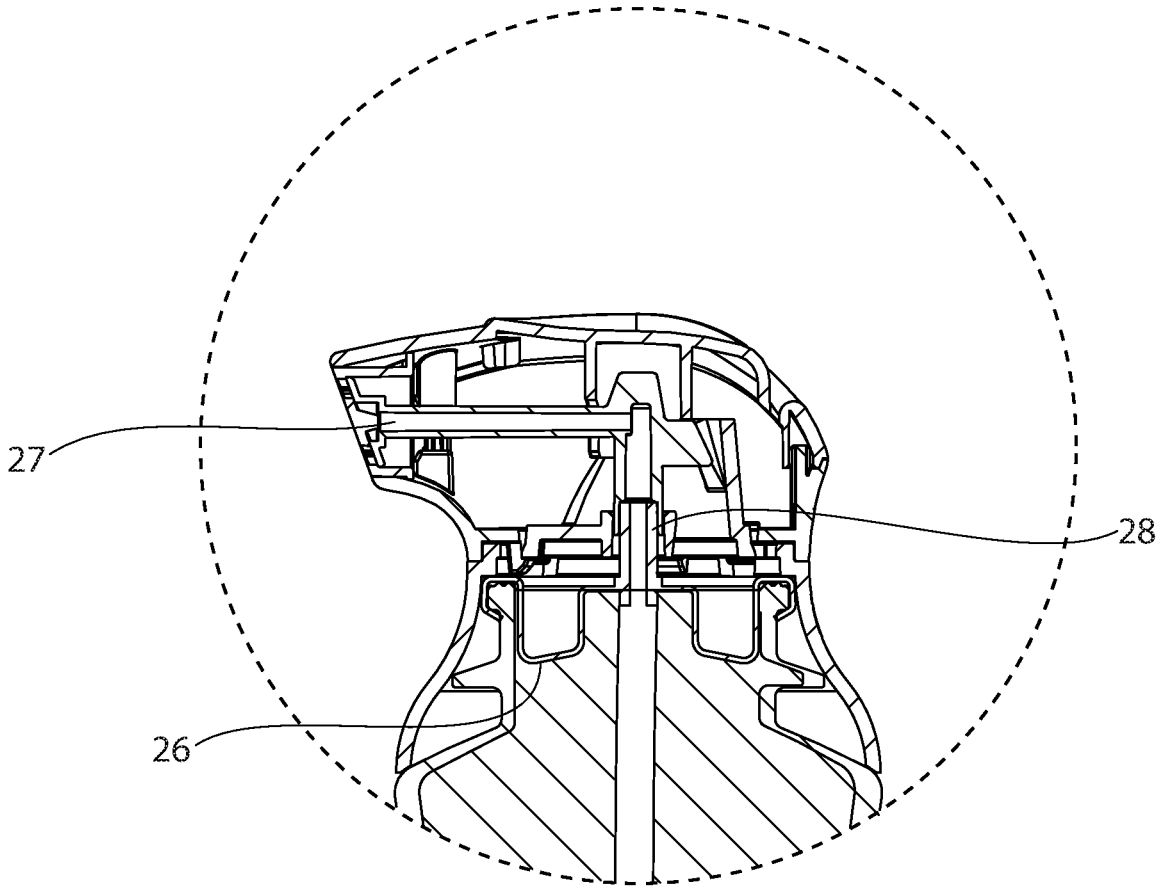
FIG. 9 is an enlarged cross-sectional view of section 9 in the aerosol dispenser of FIG. 8.

FIGS. 8 and 9 shows a cross-sectional view of the dispenser of FIG. 2 along line 8. This pump style aerosol dispenser may comprise a dip tube 34. The dip tube 34 extends from a proximal end sealed to the valve stem 28. In other examples, a female valve can be used. The dip tube 34 may terminate at a distal end juxtaposed with the bottom of the outer container 22. This embodiment provides for intermixing of the product 42 and propellant 40. Between the surface of the product and the valve stem 28 is headspace 45 that contains a vaporized portion of propellant 40.

As seen in FIG. 8, the outer container 22 may sit on a base 122. The base is disposed on the bottom of the outer container 22 and of the aerosol dispenser 20. Suitable bases include petaloid bases, champagne bases, hemispherical or other convex bases used in conjunction with a base cup, as shown in US publication 2009/0050638A1. In the example in FIG. 8, there is a champagne base, which can remain pushed up into the bottle, as shown, even when the container is used under pressure.

Referring to FIGS. 8 and 9, the pump style aerosol dispenser 20 may comprise a valve cup 26 for holding a valve stem 28 and/or dip tube 34. A plastic or metal valve cup 26 may be sealed to the opening of the outer container 22. A valve stem 28, in turn, may be disposed within the valve cup 26. The valve stem 28 provides for retention of product 42 within the aerosol dispenser 20 until the product 42 is selectively dispensed by a user. The valve stem 28 may be selectively actuated by a trigger. When the trigger is actuated it can move the valve stem to an open position allowing a mixture of product 42 and propellant 40 to move past the valve stem 28, into a dispensing channel 27, and through an orifice. The orifice can be the dispensing orifice or it can be fluidly connected to the dispensing orifice, ultimately dispensing the composition as a foam. The dispensing channel 27 and/or nozzle and/or nozzle surface can be in a fixed position relative to the outer container 22 during dispensing.

Referring to FIGS. 1-10, the aerosol dispenser 20, and components thereof, particularly the outer container 22, may have a round cross section, for improved pressure control. The sidewall 29 of the outer container 22 may be arcuate, and particularly have an oval or round cross section. Alternatively, the outer container 22, and particularly the neck 24, shoulder 25 and/or body thereof, etc., may be eccentric and have a square, elliptical, oval, irregular or other cross section. Furthermore, the cross section may be generally constant or may be variable, as shown. If a variable cross-section is selected, the outer container 22 may be teardrop shaped, spherically shaped, barrel shaped, hourglass shaped, contoured, or monotonically tapered.

The outer container 22 may range from about 100 mm to about 210 mm in height, taken in the axial direction and from about 35 to about 65 mm in diameter if a round footprint is selected, with other geometries also being feasible. The outer container 22 may have a volume ranging from 35 to 525 mL exclusive of any components therein. The outer container 22 may be injection stretch blow molded. If so, the injection stretch blow molding process may provide a planar stretch ratio greater than about 8, 8.5, 9, 9.5, 10, 12, 15 or 20 and less than about 40, 30 or 25.

The outer container 22 may be pressurized to an internal gage pressure of 100-1150, kPa and discharged to a final propellant 40 gage pressure of 0 to 120 kPa. The pressurizeable container 22 may include a propellant 40. Any suitable propellant 40, including those propellants, which can also be referred to as a blooming agent, described hereafter, may be used.

Referring to FIGS. 1-10, the outer container 22 may comprise a plastic pressurizeable container. The plastic may be polymeric, and particularly substantially or entirely comprise polyethylene terephthalate (PET) and/or polyethylene naphthalate (PEN). The outer container 22 can be colorless and/or colored. The valve assembly 28, and valve cup 26 may be welded to the neck 24 of the outer container 22.

Referring to FIGS. 1-10, if desired, the outer container 22, valve cup 26, and/or other components of the aerosol dispenser 20 may be made of sustainable materials and/or combinations and blends of sustainable and other materials. Suitable sustainable materials include polylactic acid (PLA), polyglycolic acid (PGA), polybutylene succinate (PBS), an aliphatic-aromatic copolyester optionally with high terephthalic acid content, an aromatic copolyester optionally with high terephthalic acid content, polyhydroxyalkanoate (PHA), thermoplastic starch (TPS) and mixtures thereof. Suitable materials are disclosed in commonly assigned U.S. Pat. No. 8,083,064.

If desired, the outer container 22 and/or dip tube 34, may be transparent or substantially transparent. If the outer container 22 is transparent, this arrangement provides the benefit that the consumer knows when product 42 is nearing depletion and allows for improved communication of product 42 attributes, such as color, viscosity, position of the liquid meniscus vs. the dip tube inlet, etc. If the outer container is transparent or substantially transparent, the dip tube may be also colored to achieve a visual break from the product. This can help to make the dip tube inlet even more visible by consumers. Also, labeling or other decoration of the container may be more apparent if the background to which such decoration is applied is clear. Alternatively, or additionally, the outer container 22 may be transparent and colored with like or different colors.

Figure 10A:
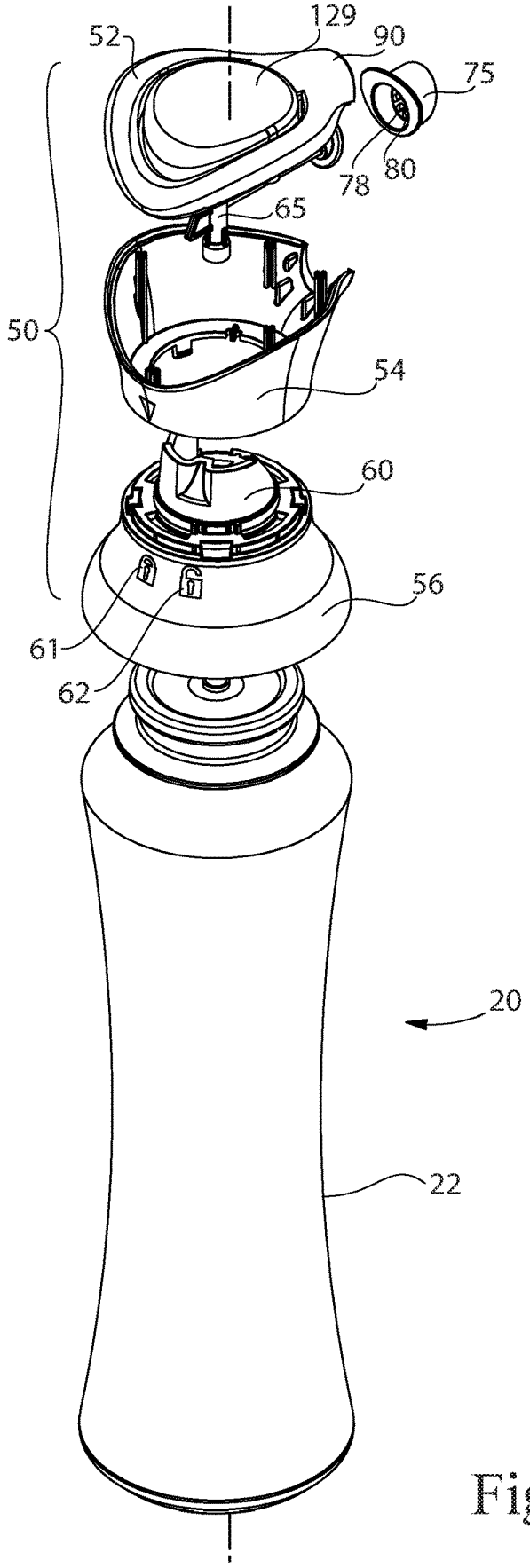
FIG. 10A is an exploded perspective view of the aerosol dispenser of FIG. 1.

FIG. 10A is an exploded perspective view of aerosol dispenser 20. Actuator 50 includes toupee 52, nozzle component 75, manifold 65, actuator body 54, and shroud 56 and in this example, these components are all separate. In other examples, some or all of these components could be a unitary piece.

Nozzle component 75 includes nozzle surface 78 and shaping orifices 80. Nozzle component 75 in combination with a portion of the toupee 52 forms nozzle 90. Nozzle component can fit under toupee 52. Nozzle component 75 could allow different nozzle components with different shaping orifices to be interchanged during manufacturing, allowing different shaped foams for different products.

Figure 10B:
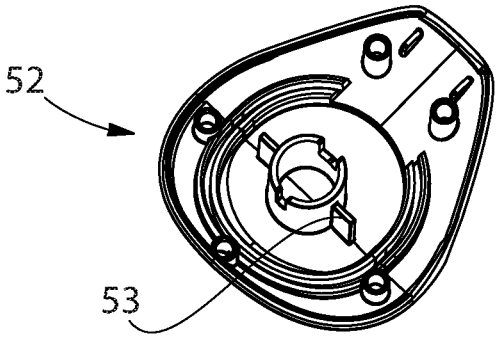
FIG. 10B is the underside of the toupee in FIG. 10A.
Figure 10C:
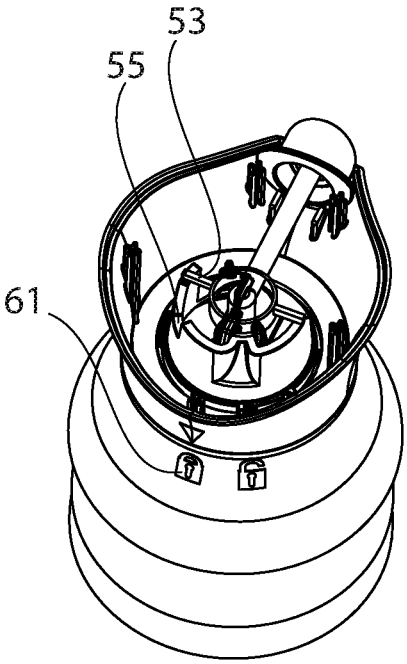
FIG. 10C is a sectioned view of the dispenser in the locked position.
Figure 10D:
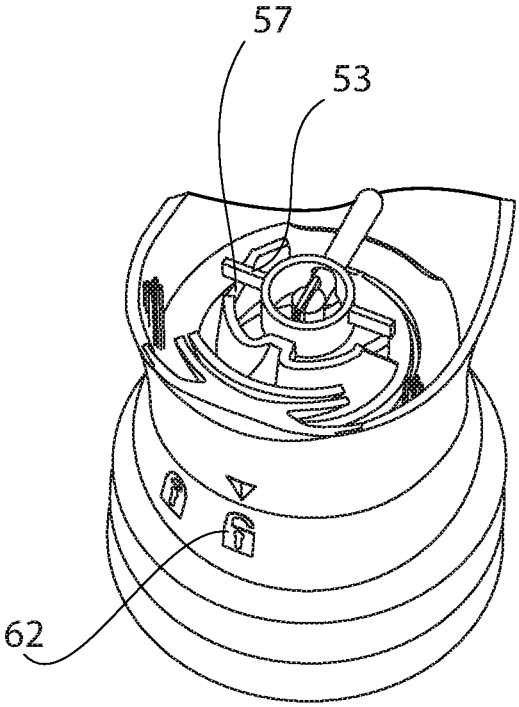
FIG. 10D is a sectioned view of the dispenser in the unlocked position.

The actuator can include different systems to prevent accidental actuation before the first use (e.g. in distribution) or between uses (e.g. while carrying the aerosol in a gym bag). Twist lock mechanisms can be compatible with the actuator designs described in this invention due to the difficulty to cover nozzles with a pronounced overhang with an over-cap. FIGS. 10B-10E show the components of the twist lock mechanism formed by shroud 56 in combination with toupee 52 and actuator body 54 forms locking mechanism 60. FIG. 10B is the underside of toupee 52 and includes ribs 53. In other examples, the ribs can be on the manifold. As shown in FIG. 10C, when shroud 56 is in the locked position 61 the ribs 53 rest on shelf 55 preventing actuation by preventing the trigger from depressing. As shown in FIG. 10D, when shroud 56 is rotated (in this example by approximately 20° and in another example about 50°) to unlocked position 62 relative to the shroud, the ribs 53 are free to drop into groove 57, allowing actuation.

The shroud can be rigidly secured to the outer container. In one example, the shroud can be secured by engaging a plurality of lock beads that irreversible snap fit to the outer container. The shroud can be rigidly secured by 3-4 contact points.

Figure 10E:
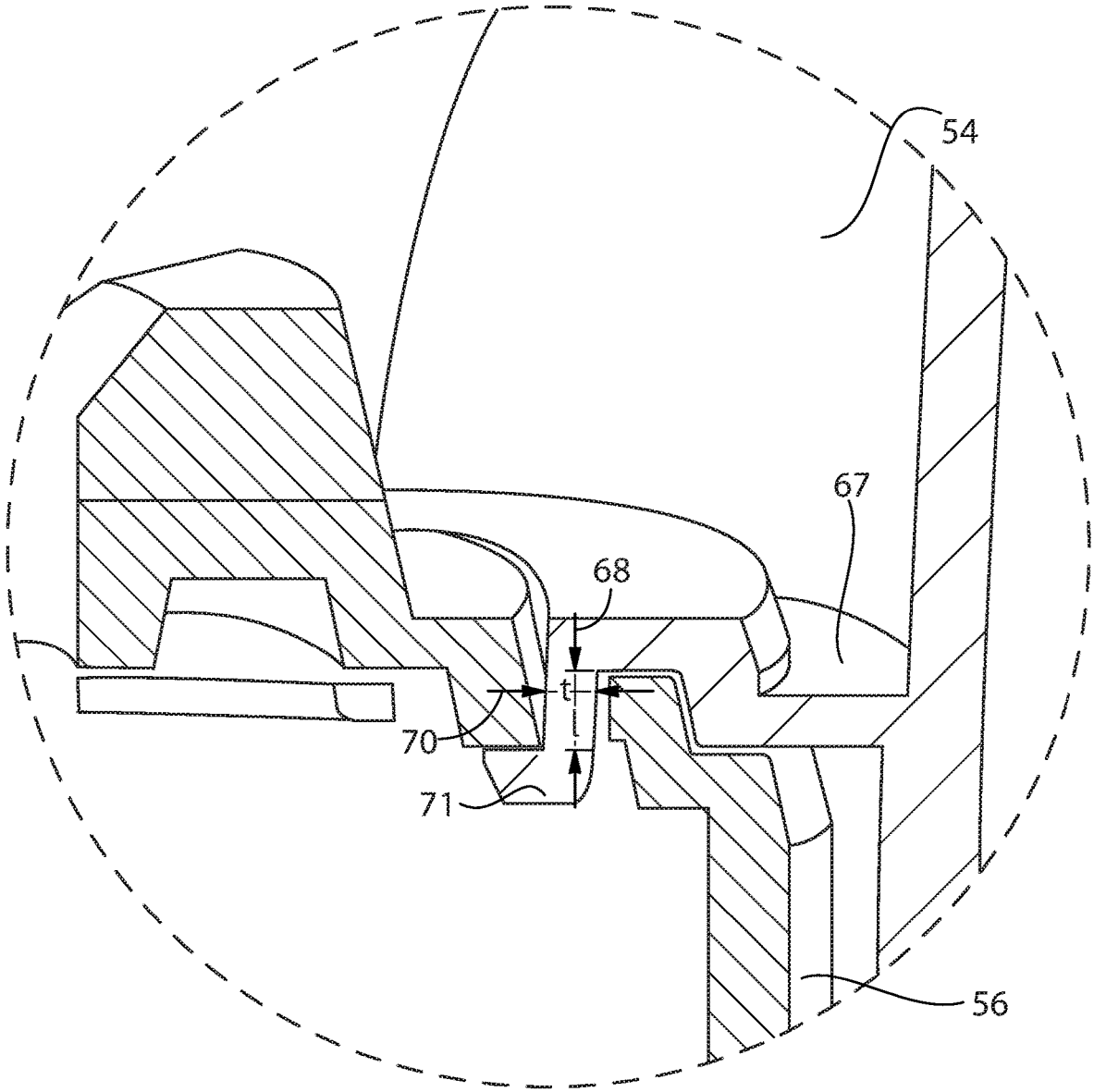
FIG. 10E is a sectional view of the latching mechanism between the shroud and the actuator body.

Furthermore, as shown in FIG. 10E, the shroud 56 and the actuator body 54 can be engaged by means of a latching mechanism inhibiting the separation of the shroud 56 from the actuator body 54 but allowing the rotation of the actuator body relatively to the shroud between the lock and the unlock position with virtually no tilting. This latching mechanism includes one or more non-releasing lock beams 68 extending from an actuator body inner platform 67 and characterized such that the beam length (l) from the base to the hook is about 1 to about 2 times the beam thickness (t) at the base 70. The beams 68 engage an equal number of slots built into the shroud. The number of beams and slots can vary based on the desired angle between the locked and unlocked position. In the specific example, four beads engage four slots to achieve about a 20° angle. In another example, three beads engage three slots to achieve about 50° angle between the unlocked to the locked position.

The latching mechanism can include beams that maintain the contact with the slots irrespective of whether or not that the dispenser is actuated. This construction can provide at least the following advantages: (1) the actuator body has substantially no tilt during actuation, as the actuation action is carried by the engagement of the trigger directly on the manifold. This was found to significantly improve control dispensing control, (2) a significantly improved separation force between the actuator body and the shroud preventing accidental disengagement/unlocking in the supply chain or during use and (3) a higher opening (unlocking) torque in the locked position which is desired to prevent unintended unlocking during distribution or consumer handling that could result in undesired dispensing.

The shroud can include one or more audible emitting ribs. Each rib can engage corresponding grooves. In one example, there can be two pairs grooves built into the actuator body: one for the intended locked and one for the unlocked positions respectively. Each rib can emit a sound both when the actuator is rotated away from/to the locked position or away from/to the unlocked position. Each rib can also cooperate with the grooves to maintain the shroud into the locked or unlocked position respectively.

Propellant

The composition described herein may comprise from about from about 2% to about 10% propellant, also referred to as a blooming agent, alternatively from about 3% to about 8% propellant, and alternatively from about 4% to about 7% propellant, by weight of the composition. The composition can be any suitable composition include shampoo, conditioner, and body wash compositions.

The propellant may comprise one or more volatile materials, which in a gaseous state, may carry the other components of the composition in particulate or droplet form. The propellant may have a boiling point within the range of from about −45° C. to about 5° C. The propellant may be liquefied when packaged in convention aerosol containers under pressure. The rapid boiling of the propellant upon leaving the aerosol foam dispenser may aid in the atomization of the other components of the composition.

Aerosol propellants which may be employed in the aerosol composition may include the chemically-inert hydrocarbons such as propane, n-butane, isobutane, cyclopropane, and mixtures thereof, as well as halogenated hydrocarbons such as dichlorodifluoromethane, 1,1-dichloro-1,1,2,2-tetrafluoroethane, 1-chloro-1,1-difluoro-2,2-trifluoroethane, 1-chloro-1,1-difluoroethylene, 1,1-difluoroethane, dimethyl ether, monochlorodifluoromethane, trans-1-chloro-3,3,3-trifluoropropene, trans-1,3,3,3-tetrafluoropropene (HFO 1234ze available by Honeywell), and mixtures thereof. The propellant may comprise hydrocarbons such as isobutane, propane, and butane—these materials may be used for their low ozone reactivity and may be used as individual components where their vapor pressures at 21.1° C. range from about 1.17 Bar to about 7.45 Bar, alternatively from about 1.17 Bar to about 4.83 Bar, and alternatively from about 2.14 Bar to about 3.79 Bar. The propellant may comprise an Isobutane/Propane blend, such as A46 from Aeropres Corp (Hillsborough US). The propellant may comprise hydrofluoroolefins (HFOs).

Test Methods

Actuation Direction

To determine the actuation direction, first, the centroid of the actuation surface of the trigger is determined. The actuation surface of the trigger is the portion of the trigger that transfers the force from the user's finger(s) to the valve allowing the product to be discharged.

The centroid will be projected to the convex hull of the actuation surface.

A vector is drawn from the projected centroid, in the direction of actuation, normal to the surface of the convex hull. If there is more than one such normal vector, then the relevant vector is the one that exhibits the shortest perpendicular distance from the centroid to the convex hull. If it is not possible to uniquely identify such a normal vector, then the actuation direction can be defined as the mean direction of all identified normal vectors.

A line is drawn through the projected centroid that is parallel to the aerosol dispenser axis of symmetry (or valve axis of symmetry if the dispenser is not axial symmetric). The angle between this line and the vector is measured to determine the actuation direction. The 0° angle is identified by the actuation direction parallel to the axis of symmetry and pointing towards the base.

The actuation direction may change from the start to the finish of the dispensing. The actuation direction at the start is measured before the trigger is actuated. The actuation direction at the finish is measured when the trigger is at the full stroke position.

Aerosol Dispenser Tilt Angle

The aerosol dispenser tilt angle is determined by film recording individuals dispensing the aerosol dispenser in the unlock i.e. dispense-ready position. To minimize any bias/error with the measurement: (1) the camera lens must be placed approximately 500-1000 mm in front of the consumers and oriented horizontally; (2) the consumer must stand facing the camera frontally during dispensing so that the container axis of symmetry is about perpendicular to the camera lens axis. Three measurements for users are taken for a minimum base size of 28 global non-impaired users (e.g. without arthritis, rheumatism, or limited range of motion etc.) selected such that their hand size is between the $5^{ile}$ to the $95^{ile}$ of the global population between 18 to 65 years old. The tilt angle is generated by analyzing the videos using a software such as CAMTASIA STUDIO 8® and measured at the point the user presses on the actuator button or trigger. All values generated are then collected and analyzed using a statistical evaluation software such as JMP12®. Then the average, standard deviation and 98% ile value for the tilt angle is calculated for each product.

Nozzle Direction

To determine the nozzle direction, first, the centroid of the one or more shaping orifices is determined. Depending on the shape of the shaping orifice, and whether it consists of multiple discreet portions, the centroid may or may not be included in the shaping orifice or on the nozzle surface. For example, if the open surface consists of two discrete, spaced apart orifices, then the centroid may be located between the two orifices. In another example, if the nozzle surface is concave, the centroid could be located above the nozzle surface. In another example, the nozzle surface is convex, the centroid is located below the nozzle surface.

The centroid will be projected to the surface of the convex hull of the nozzle surface. In many instances, the centroid and projected centroid are at the same point.

A vector is drawn from the projected centroid, away from the nozzle, and normal to the surface of the convex hull.

A line is drawn through the projected centroid that is parallel to the aerosol dispenser axis of symmetry (or valve axis of symmetry if the dispenser is not axial symmetric). The angle between this line and the vector is measured to determine the nozzle direction. The 0° angle is identified by the nozzle direction parallel to the axis of symmetry and pointing towards the base.

Dispensing Observational Behavior Research

Figure 12:
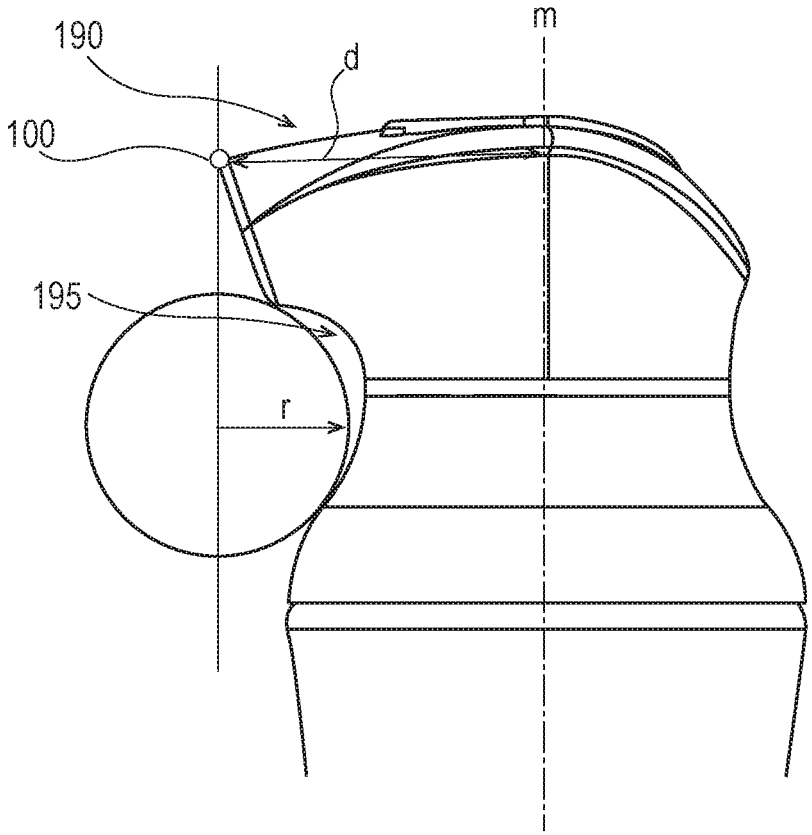
FIG. 12 is a schematic of an embodiment of the aerosol dispenser with an overhang that is shaped to accommodate a semi-cylinder with a radius r.

Observational behavioral research is performed by video recording consumers dispensing an aerosol while performing a task i.e. during their hair washing routine. The research is performed on at least 28 global adult non-impaired users (e.g. without arthritis, rheumatism, or limited range of motion etc.) selected such that their hand size is between the $5^{ile}$ to the $95^{ile}$ of the global population between 18 to 65 years old. The following information is extracted from the videos:

- Any compensating behavior i.e. observe if consumers are using the aerosol in a manner which is different versus the original design intent
- The mean time to actuate; this is the amount of time between when the consumer grips the aerosol dispenser in an unlocked configuration that he/she has not used before and actuates it to dispense product without instructions. The mean time to actuate provides an indication of the dispensing intuitiveness Overhang Radius As shown in FIG. 12, overhang 95 can have a length that is equivalent to radius r. The length of radius r can be determined by taking a side view of the dispenser and finding the furthest point on the nozzle from the dispenser's axis of symmetry (or valve axis of symmetry if the dispenser is not axial symmetric) and defining a plane passing through this point. The plane is parallel to the dispenser's axis of symmetry. Then, a half-cylinder is created with the flat portion lying on the plane that is the maximum size without penetrating the package. In the example in FIG. 12, 100 is the farthest point on the nozzle from the container axis of symmetry m.

Peak Force-to-Actuate

The aerosol peak force-to-actuate is measured according the ASTM D6534-18 'Standard Practice for Determining the Peak Force-to-Actuate of a Mechanical Pump Dispenser'. The samples are conditioned for at least 24 hours at room temperature before dispensing. The pump heads are actuated at a speed of 50 mm/sec at 90% stroke length. The compression force tester used is an Instron® 8500 or equivalent tester capable of meeting the required head speed and accuracy of 0.1 Newtons.

EXAMPLES

For the Examples in Tables 1-3, the tilt angle was determined by observing 35 panelists interacting with Examples A-N and Examples 1-3. A video was taken to determine (1) how quickly panelist determined how to actuate; and (2) inclination during actuation. The panelists actuated each product three times. The average tilt and standard deviation was calculated and the 98% ile value reported in the table

TABLE 1

Figure 13A:
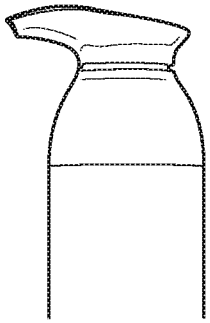
FIG. 13A is the actuator used in Example A.
Figure 13B:
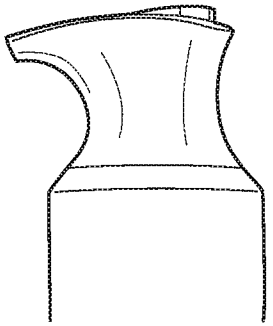
FIG. 13B is the actuator used in Example B.
Figure 13C:
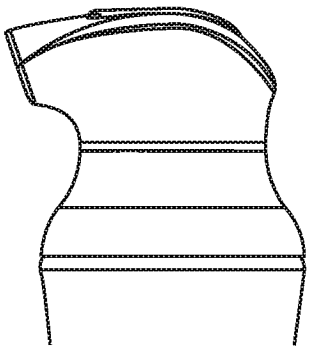
FIG. 13C is the actuator used in Example C.
Figure 13D:
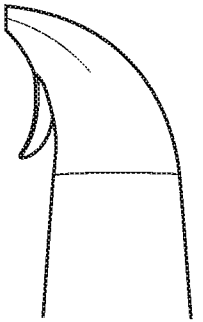
FIG. 13D is the actuator used in Example D.
Figure 13E:
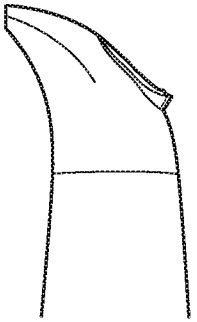
FIG. 13E is the actuator used in Example E.
Figure 13F:
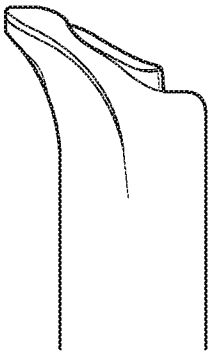
FIG. 13F is the actuator used in Example F.
Figure 13I:
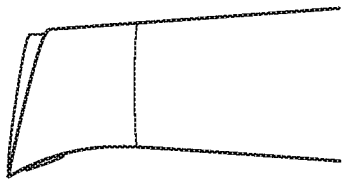
FIG. 13I is the actuator used in Example I.
Figure 13L:
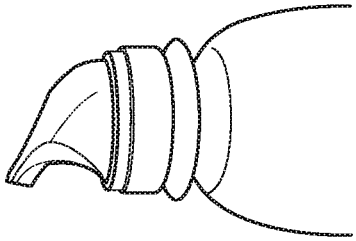
FIG. 13L is the actuator used in Example L.
Figure 13H:
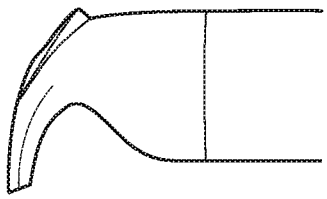
FIG. 13H is the actuator used in Example H.
Figure 13K:
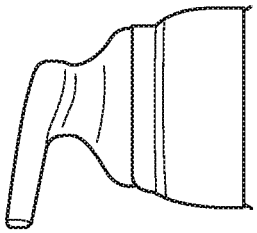
FIG. 13K is the actuator used in Example K.
Figure 13G:
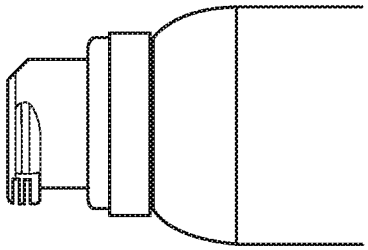
FIG. 13G is the actuator used in Example G.

| Actuator | Ex. A FIG. 13A | Ex. B FIG. 13B | Ex. C FIG. 13C | Ex. D FIG. 13D | Ex. E FIG. 13E | Ex. F FIG. 13E | Ex. G FIG. 13G |
|---|---|---|---|---|---|---|---|
| Nozzle Direction | 78° | 85° | 80° | 110° | 110° | 55° | 90° |
| Overhang Radius, mm | 22 | 20 | 12 | 8 | 15 | 15 | 2 |
| Actuation Direction at Beginning of Stroke | 0° | −5° | 6° | 70° | 45° | 15° | 12° |
| Actuation Direction at End of Stroke | 17° | 0° | 16° | 90° | 50° | 35° | 7° |
| 98 %ile Tilt Angle | 37° | 52° | 76° | 112° | 125° | 55° | 120° |
| Mean Time to Actuate, s | <3 | <3 | <3 | <3 | <3 | <3 | <3 |

TABLE 2

Figure 13J:
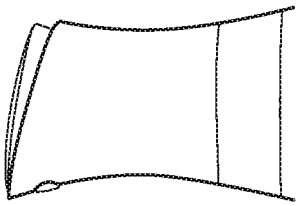
FIG. 13J is the actuator used in Example J.
Figure 13M:
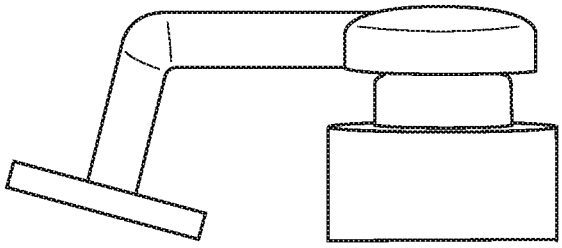
FIG. 13M is the actuator used in Example M.
Figure 13N:
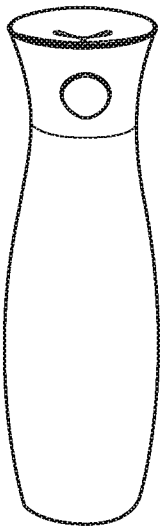
FIG. 13N is the actuator used in Example N.

| Actuator | Ex. H FIG. 13H | Ex. I FIG. 13I | Ex. J FIG. 13J | Ex. K FIG. 13K | Ex. L FIG. 13L | Ex. M FIG. 13M | Ex. N FIG. 13N |
|---|---|---|---|---|---|---|---|
| Nozzle Direction | 95° | 75° | 85° | 95° | 115° | 10° | 180° |
| Overhang Radius, mm | 25 | 9 | 5 | 10 | 5 | 30 | 0 |
| Actuation Direction at Beginning of Stroke | 35° | 10° | 15° | 15° | 25° | 0° | 90° |

TABLE 2-continued

| Actuator | Ex. H FIG. 13H | Ex. I FIG. 13I | Ex. J FIG. 13J | Ex. K FIG. 13K | Ex. L FIG. 13L | Ex. M FIG. 13M | Ex. N FIG. 13N |
|---|---|---|---|---|---|---|---|
| Actuation Direction at End of Stroke | 45° | 15° | 20° | 10° | 20° | 0° | 90° |
| 98 %ile Tilt Angle | 65° | 134° | 111° | 106° | 123° | 22° | 249° |
| Mean Time to Actuate, s | <3 | <3 | <3 | <3 | <3 | <3 | >3 |

Examples A, B, C, F, H, and M are examples that have a nozzle direction, overhang, and actuation direction that leads to a tilt angle that is less than 90°, which indicates that these bottles are less likely to degas and can provide a high-quality foam for the duration of dispensing. Example H has a large overhang (radius of 25 mm), this large overhang reduces tilt even though the nozzle direction points slightly up (95°). Example M not only has the most downward nozzle direction) (10°), it also has a large nozzle surface that can further minimize the tilt variability. However, the large overhang radius and the bend in the nozzle could make Example M difficult to ship, manufacture, and store in one's shower where there is generally limited storage space.

In Example D, the trigger is below the nozzle and to actuate the trigger panelists move the trigger in a direction that is substantially normal to the axis of symmetry. It was found that when actuating this example, panelists tend to keep the trigger parallel to the ground and they tilt the dispenser too far while actuating, which will ultimately result in the dispenser degassing and dispensing runny, low-quality foam.

In Example E, the nozzle direction is upwards (110°) and the trigger is on the side of the actuator. Again, it was found that panelists tilted the dispenser too far while actuating.

In Examples G, I, and J have overhangs that are too small. This also resulted in substantial tilting when actuating the device and therefore these actuators is not preferred for dip tube aerosols.

Example K has the same nozzle direction as Example H. However, since Example K has a small overhang (10 mm), it was found that panelists title the dispenser too far (106°) when actuating and therefore this combination is not preferred.

Example L has a nozzle that points upwards (115°) and a small overhang (5 mm) and it was found that panelists tilt this dispenser too far (123°) when actuating.

In Example N, the nozzle points upwards (180°), there was no overhang, and panelists actuated the dispenser by pressing a button on the side of the actuator. Not only did this result in a substantial tilt (249°), but the mean time to actuate was too long (>3 second) and it was prone to misuse. Furthermore, many panelists used and/or stored Example N upside down. Panelists generally want a dispenser that will dispense high quality foam for the entire life of the produce and they also want something that is simple, fast, and intuitive to use.

Figure 14:
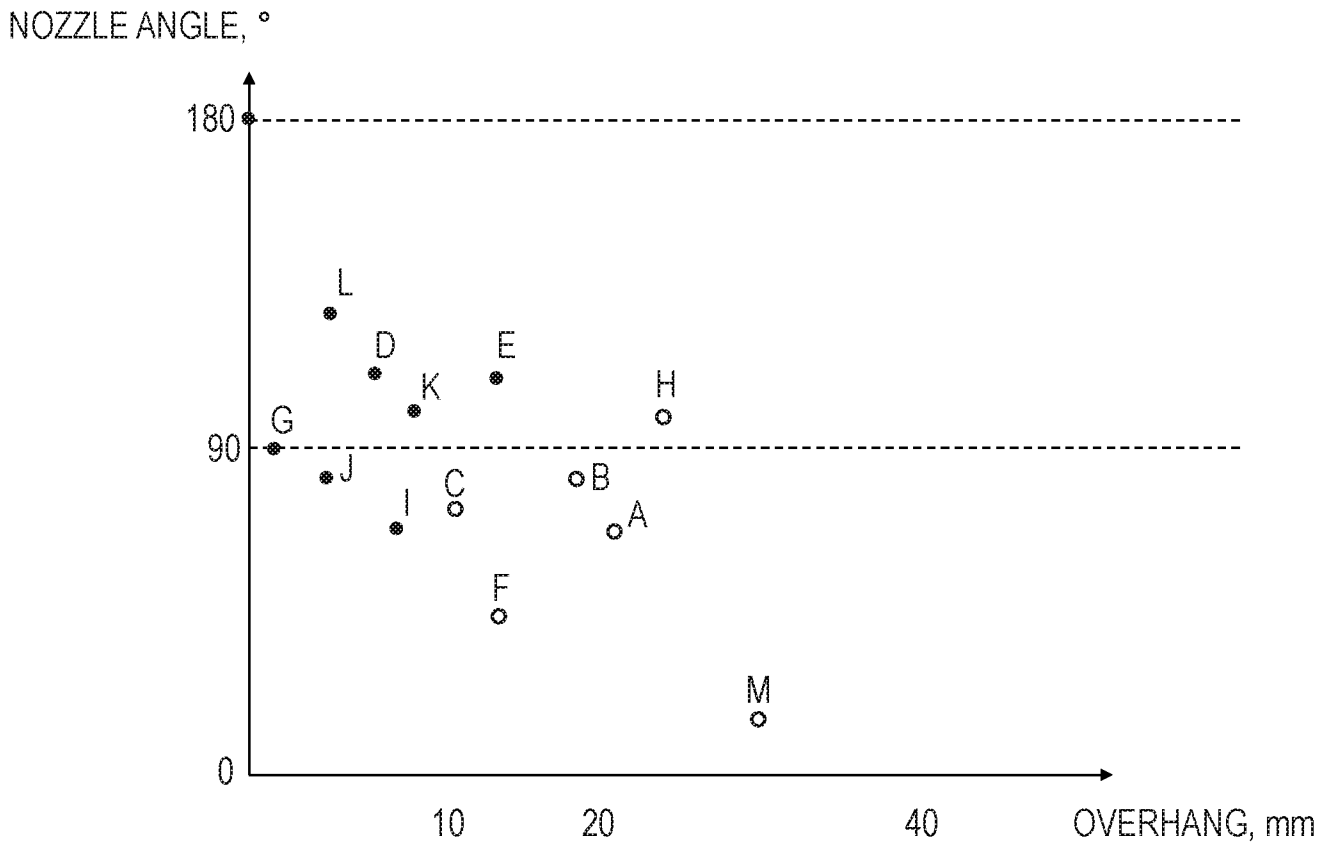
FIG. 14 is a scatterplot of nozzle angle vs. overhang radius for Examples A to N.

FIG. 14 is a scatterplot of Examples A-N and compares nozzle angle vs. overhang. FIG. 14 shows that examples with a larger overhang and lower nozzle angle generally result in less tilting during actuation.

TABLE 3

Figure 15A:
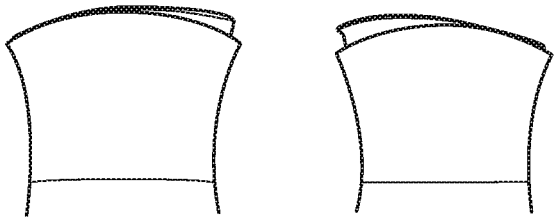
FIG. 15A is the actuator used in Example 1.
Figure 15B:
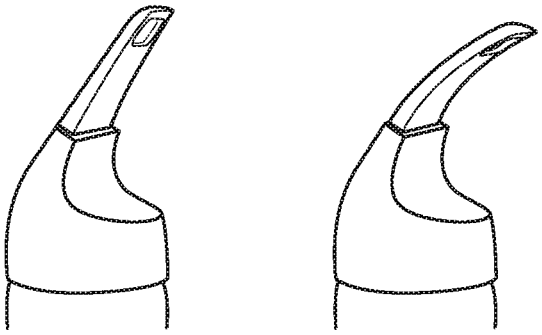
FIG. 15B is the actuator used in Example 2.
Figure 15C:
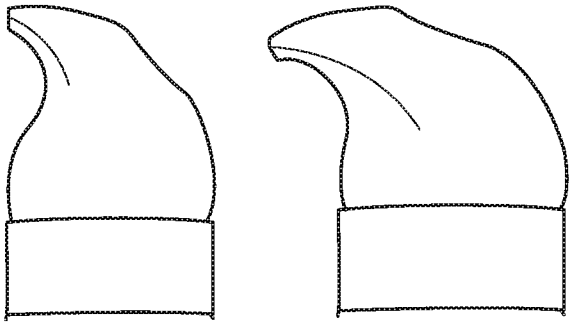
FIG. 15C is the actuator used in Example 3.

| | Ex. 1 | Ex. 2 | Ex. 3 |
|---|---|---|---|
| Actuator | FIG. 15A | FIG. 15B | FIG. 15C |
| Nozzle Direction at Beginning of Stroke | 80° | 45° | 90° |
| Nozzle Direct at End of Stroke | 90° | 60° | 60° |
| Overhang Radius at Beginning of Stroke, mm | 0 | 20 | 10 |
| Overhang Radius at End of Stroke, mm | 0 | 25 | 20 |
| Actuation Direction at Beginning of Stroke | 90° | 45° | 45° |
| Actuation Direction at End of Stroke | 90° | 30° | 15° |
| 98% ile Tilt Angle | 249° | N/A | 117° |
| MeanTime to Actuate, s | >3 | >3 | >3 |

Examples 1, 2, and 3 in

Table 3 were not preferred by the panelists, in part, because they were not intuitive to actuate. The panelists struggled with these dispensers because the nozzle direction varied during dispensing. This was especially true when the nozzle/orifice is not even visible before actuation, like Example 1 (see FIG. 15A). Thus, it can be advantageous for the dispenser to have a nozzle direction that does not vary during dispensing. Furthermore, in Examples 1-3, the panelists were not sure where and/or when the foam product would be dispensed, while holding the container and actuating using the same hand. Even after being shown how to use the dispensing mechanism, consumers may still struggle, since when using a product in a shower, consumers tend to use these products without thinking much (i.e. on auto-pilot) and can prefer to stick to familiar dispensing habits Combinations A. An aerosol dispenser with an axis of symmetry comprising:
   a. a pressurizable outer container for storing a propellant and a composition under pressure;
   b. an actuator having an outer surface where the actuator is attached to a top of the outer container comprising:
      i. a valve being movable to an open position to release a mixture of the aerosol and the composition;
      ii. a trigger located above the valve for actuating the valve where the trigger has a direction of actuation from about −10° to about 60° from the axis of symmetry of the dispenser at the beginning of a stroke;
      iii. a longitudinally extending nozzle having a top surface, a bottom surface, a nozzle surface comprising one or more shaping orifices with a nozzle direction from less than or equal to 85° from the axis of symmetry of the dispenser;
         wherein said orifices are in fluid communication with the valve;
         wherein the bottom surface and the outer surface of the actuator create an overhang adapted for receiving the at least a portion of a little finger on a user's receiving hand;
         wherein the overhang is shaped to accommodate a semi-cylinder with a radius from about 10 mm to about 30 mm;
   c. a dip tube where an end of the dip tube is connected to the valve.

B. An aerosol dispenser with an axis of symmetry comprising:
   a. a pressurizable outer container for storing a propellant and a composition under pressure;
   b. an actuator having an outer surface where the actuator is attached to a top of the outer container comprising:
      i. a valve being movable to an open position to release a mixture of the aerosol and the composition;
      ii. a trigger located above the valve for actuating the valve where the trigger has a direction of actuation from about −10° to about 60° from the axis of symmetry of the dispenser at the beginning of a stroke;
      iii. a longitudinally extending nozzle having a top surface, a bottom surface, a nozzle surface comprising one or more shaping orifices with a nozzle direction less than 100° from the axis of symmetry of the dispenser;
         wherein the bottom surface and the outer surface of the actuator create an overhang adapted for receiving the at least a portion of a little finger on a user's receiving hand;
         wherein the overhang is shaped to accommodate a semi-cylinder with a radius greater than 20 mm;
      iv. a dip tube where an end of the dip tube is connected to the valve.

C. The aerosol dispenser according to Paragraph A, wherein the overhang can be shaped to accommodate a semi-cylinder with a radius from about 12 mm to about 30 mm, preferably from about 15 mm to about 28 mm, and more preferably from about 15 mm to about 25 mm, according to the Overhang Radius Method, described herein.

D. The aerosol dispenser according to Paragraphs A-C, wherein the direction of actuation is from about −7° to about 60° from the axis of symmetry of the dispenser, preferably from about −5° to about 45° from the axis of symmetry of the dispenser.

E. The aerosol dispenser according to Paragraphs A-D, wherein the actuator further comprises a shroud attached to the top of the outer container.

F. The aerosol dispenser according to Paragraphs A-E, wherein the aerosol dispenser further comprises a dispensing channel for receiving a mixture of product and propellant when the valve is in an open position, wherein the dispensing channel remains in a fixed position relative to the outer container during actuation of the trigger.

G. The aerosol dispenser according to Paragraphs A-F, wherein the nozzle remains in fixed position relative to the to the container during actuation of the trigger.

H. The aerosol dispenser according to Paragraphs A-G, wherein the actuator and/or an actuator body has substantially no tilt during actuation.

I. The aerosol dispenser according to Paragraphs A-H, wherein the outer container comprises a plastic selected from the group consisting of polyethylene terephthalate, polyethylene naphthalate, and combinations thereof.

J. The aerosol dispenser according to Paragraphs A-I, wherein the outer container is transparent or substantially transparent.

K. The aerosol dispenser according to Paragraphs A-J, wherein the composition is selected from the group consisting of shampoo, conditioner, body wash, and combinations thereof.

L. The aerosol dispenser according to Paragraphs A-K, wherein the nozzle surface is substantially flat and comprises a surface area from about 50 $mm^2$ to about 2500 $mm^2$, preferably from about 100 $mm^2$ to about 1250 $mm^2$, more preferably from about 200 $mm^2$ to about 750 $mm^2$, and even more preferably from about 300 $mm^2$ to about 500 $mm^2$.

M. The aerosol dispenser according to Paragraphs A-L, wherein the actuator further comprises: a shroud fixed to the outer container and an actuator body rotatably fixed to the shroud wherein the actuator body rotates between a locked and unlocked position.

N. The lockable aerosol dispenser according to Paragraph M, further comprising at least an audible rib in the shroud cooperating with two grooves in the top assembly to produce an audible sound when the actuator is twisted from the locked to the dispense ready position and vice versa.

O. A method of dispensing a foam from an aerosol container comprising:
- a. providing the aerosol foam dispenser according to Paragraphs A-N;
- b. actuating the trigger;
- c. dispensing a foam composition;
  - wherein during actuation, the aerosol dispenser comprises a 98% ile tilt angle of about 0° to about 90° relative to an axis perpendicular to the ground.

P. The method according to Paragraph O, wherein during actuation wherein during actuation, the aerosol dispenser comprises a 98% ile tilt angle of about 0° to about 76° relative to an axis perpendicular to the ground.

Q. The method according to Paragraphs O-P, wherein during actuation wherein during actuation, the aerosol dispenser comprises a 98% ile tilt angle of about 0° to about 67.5° relative to an axis perpendicular to the ground.

R. The method of according to paragraphs O-Q, wherein before actuating the outside of the receiving hand or the side of the little finger is brought adjacent to the overhang.

S. The method of according to paragraphs O-R, wherein the peak force to actuate is from about 5 N to about 40 N, preferably from about 5 N to about 35 N, preferably from about 5 N to about 30 N, and even more preferably from about 5 N to about 20 N.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application and any patent application or patent to which this application claims priority or benefit thereof, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. An aerosol dispenser with an axis of symmetry comprising:
- a. a pressurizable outer container for storing a propellant and a composition under pressure;
- b. an actuator having an outer surface where the actuator is attached to a top of the outer container comprising:
  - i. a valve being movable to an open position to release a mixture of the aerosol and the composition;
  - ii. a trigger located above the valve for actuating the valve where the trigger has a direction of actuation from about −10° to about 60° from the axis of symmetry of the dispenser at the beginning of a stroke;
  - iii. a longitudinally extending nozzle having a top surface, a bottom surface, a nozzle surface comprising one or more shaping orifices with a nozzle direction from less than or equal to 85° from the axis of symmetry of the dispenser;
    - wherein said orifices are in fluid communication with the valve;
    - wherein the bottom surface and the outer surface of the actuator create an overhang adapted for receiving the at least a portion of a little finger on a user's receiving hand;
    - wherein the overhang is shaped to accommodate a semi-cylinder with a radius from about 10 mm to about 30 mm;
- c. a dip tube where an end of the dip tube is connected to the valve.

2. The aerosol dispenser of claim 1 wherein the overhang is shaped to accommodate a semi-cylinder with a radius from about 11 mm to about 25 mm.

3. The aerosol dispenser of claim 1 wherein the direction of actuation is from about −7° to about 60° from the axis of symmetry of the dispenser.

4. The aerosol dispenser of claim 3 wherein the direction of actuation is from about −5° to about 45° from the axis of symmetry of the dispenser.

5. The aerosol dispenser of claim 1 wherein the actuator further comprises a shroud attached to the top of the outer container.

6. The aerosol dispenser of claim 1 wherein the aerosol dispenser further comprises a dispensing channel for receiving a mixture of product and propellant when the valve is in an open position, wherein the dispensing channel remains in a fixed position relative to the outer container during actuation of the trigger.

7. The aerosol dispenser of claim 1 wherein the nozzle remains in a fixed position relative to the outer container during actuation of the trigger.

8. The aerosol dispenser of claim 1 wherein the outer container comprises a plastic selected from the group consisting of polyethylene terephthalate, polyethylene naphthalate, and combinations thereof.

9. The aerosol dispenser of claim 1 wherein the composition is selected from the group consisting of shampoo, conditioner, body wash, and combinations thereof.

10. The aerosol dispenser of claim 1 wherein the nozzle surface is substantially flat and comprises a surface area from about 100 $mm^2$ to 1250 $mm^2$.

11. The aerosol dispenser of claim 10 wherein the nozzle surface is substantially flat and comprises a surface area from about 300 $mm^2$ to 500 $mm^2$.

12. The aerosol dispenser of claim 1 wherein the actuator further comprises a shroud fixed to the outer container and an actuator body rotatably fixed to the shroud wherein the actuator body rotates between a locked and unlocked position.

13. An aerosol dispenser with an axis of symmetry comprising:

a. a pressurizable outer container for storing a propellant and a composition under pressure;

b. an actuator having an outer surface where the actuator is attached to a top of the outer container comprising:

i. a valve being movable to an open position to release a mixture of the aerosol and the composition;

ii. a trigger located above the valve for actuating the valve where the trigger has a direction of actuation from about −10° to about 60° from the axis of symmetry of the dispenser at the beginning of a stroke;

iii. a longitudinally extending nozzle having a top surface, a bottom surface, a nozzle surface comprising one or more shaping orifices with a nozzle direction less than 100° from the axis of symmetry of the dispenser;

wherein the bottom surface and the outer surface of the actuator create an overhang adapted for receiving the at least a portion of a little finger on a user's receiving hand;

wherein the overhang is shaped to accommodate a semi-cylinder with a radius greater than 20 mm;

iv. a dip tube where an end of the dip tube is connected to the valve.

14. A method of dispensing a foam from an aerosol container comprising:

a. providing the aerosol foam dispenser of claim 1;

b. actuating the trigger;

c. dispensing a foam composition;

wherein during actuation, the aerosol dispenser comprises a 98% ile tilt angle of about 0° to about 90° relative to an axis perpendicular to the ground.

15. The method of claim 14 wherein during actuation wherein during actuation, the aerosol dispenser comprises a 98% ile tilt angle of about 0° to about 76° relative to an axis perpendicular to the ground.

16. The method of claim 15 wherein during actuation wherein during actuation, the aerosol dispenser comprises a 98% ile tilt angle of about 0° to about 67.5° relative to an axis perpendicular to the ground.

17. The method of claim 14 wherein before actuating the outside of the receiving hand or the side of the little finger is brought adjacent to the overhang.

18. The method of claim 14 wherein the peak force to actuate to from about 5N to about 35 N.

19. The method of claim 18 wherein the peak force to actuate to from about 5N to about 20 N.

20. The method of claim 14 wherein the actuator body has substantially no tilt during actuation.

* * * * *